US007131376B2

(12) United States Patent
Yamamoto et al.

(10) Patent No.: US 7,131,376 B2
(45) Date of Patent: Nov. 7, 2006

(54) INK FEEDING METHOD AND INK FEEDING APPARATUS

(75) Inventors: Takaharu Yamamoto, Kyoto (JP); Kazuya Takeda, Kyoto (JP); Kazuki Fukui, Kyoto (JP)

(73) Assignee: Dainippon Screen Mfg. Co., Ltd., Kyoto (JP)

( * ) Notice: Subject to any disclaimer, the term of this patent is extended or adjusted under 35 U.S.C. 154(b) by 161 days.

(21) Appl. No.: 10/944,899

(22) Filed: Sep. 21, 2004

(65) Prior Publication Data

US 2005/0061176 A1 Mar. 24, 2005

(30) Foreign Application Priority Data

Sep. 22, 2003 (JP) ..... 2003-329438

(51) Int. Cl.
*B41F 31/00* (2006.01)
*B41F 1/34* (2006.01)

(52) U.S. Cl. ..... 101/350.1; 101/365; 101/484; 101/485

(58) Field of Classification Search ..... 101/350.1, 101/365, 484, 485
See application file for complete search history.

(56) References Cited

U.S. PATENT DOCUMENTS 5,967,049 A * 10/1999 Seymour et al. ..... 101/484
6,832,550 B1 * 12/2004 Martin et al. ..... 101/349.1
2001/0011510 A1 * 8/2001 Koehler ..... 101/350.1
2002/0015016 A1 2/2002 Kudo et al.

FOREIGN PATENT DOCUMENTS

JP 1-208135 8/1989
JP 2000-108308 A 4/2000

* cited by examiner

*Primary Examiner*—Daniel J. Colilla
*Assistant Examiner*—Marvin P. Crenshaw
(74) *Attorney, Agent, or Firm*—McDermott Will & Emery LLP

(57) ABSTRACT

An ink feeding method includes a density reading step for reading density data obtained by measuring densities of detecting patches on a first image, before an end of a printing operation, a first computing step for computing, from the density data, an ink feed film thickness remaining after prints having the first image are made, a second computing step for computing an ink feed film thickness required for making prints having a second image, from a target density for the prints having the second image, a third computing step for computing a preset ink feeding rate from the ink feed film thickness remaining after the prints having the first image are made, computed in the first computing step, and the ink feed film thickness required for making the prints having the second image, computed in the second computing step, and an ink feeding step for feeding the preset ink based on the preset ink feeding rate computed in the third computing step.

19 Claims, 6 Drawing Sheets

INK FEEDING METHOD AND INK FEEDING APPARATUS

BACKGROUND OF THE INVENTION

1. Field of the Invention

This invention relates to an ink feeding method and ink feeding apparatus for feeding a preset ink after making prints having a first image and before making prints having a second image.

2. Description of the Related Art

When making a plurality of prints continuously with a printing machine, the quantity of ink corresponding to the image of preceding prints remains on the ink rollers of the printing machine. Thus, for continuing to make prints having a different image, a presetting operation is carried out for adjusting a thickness of ink film on the ink rollers to a size corresponding to the image to be printed next. In this presetting operation, for example, the thickness of ink film on the ink rollers is uniformed by removing the ink, and then the film thickness is adjusted to the image to be printed next.

However, when the presetting operation is carried out in the two stages as above, the ink is consumed in a wasteful quantity, and the operation takes a long time also.

Further, ink presetting methods have been proposed, in which an image printed previously is measured, and a thickness of ink film is adjusted in time of presetting based on measured values (Japanese Unexamined Patent Publications No. 1989-208135 and No. 2000-108308).

However, one of the above methods is a technique relating to a proof press, which estimates a remaining quantity of ink from the number of sheets printed after the latest ink feeding event. Such a technique is unsuitable to a printing machine that feeds ink continuously.

The other of the above methods determines beforehand a correspondence between actual ink key opening degree and printing area ratio in an excellent printing state, and merely uses such data in subsequent printing operations. Thus, a change in the operating state or printing conditions of the printing machine could render such data obtained from an actual situation unusable. In addition, the thickness of remaining ink film is variable with the state in which a printing operation is ended.

SUMMARY OF THE INVENTION

The object of this invention, therefore, is to provide an ink feeding method and ink feeding apparatus for allowing an ink presetting operation to be carried out quickly and accurately.

The above object is fulfilled, according to this invention, by an ink feeding method for feeding a preset ink after making prints having a first image and before making prints having a second image, the method comprising:

a density reading step for reading density data obtained by measuring densities of the prints having the first image, before an end of a printing operation;

a first computing step for computing, from the density data, an ink feed film thickness remaining after the prints having the first image are made;

a second computing step for computing an ink feed film thickness required for making the prints having the second image, from a target density for the prints having the second image; and a third computing step for computing a preset ink feeding rate from the ink feed film thickness remaining after the prints having the first image are made, computed in the first computing step, and the ink feed film thickness required for making the prints having the second image, computed in the second computing step.

With this ink feeding method, an ink presetting operation may be carried out quickly and accurately.

In a preferred embodiment, the preset ink feeding rate comprises an ink feed film thickness and the number of times of ink feeding by an ink transfer roller.

The density data may be obtained by measuring the densities a plurality of times serially and immediately before the end of the printing operation.

The first computing step and the second computing step may be executed by performing computations using the following equation (1):

$$T=\alpha*(a*D+b)+\beta \quad (1)$$

where D is a density of detecting patches, T is an ink film thickness on ink rollers, α and β are factors of conversion from an ink film thickness on printing paper to the ink film thickness on the ink rollers, and a and b are factors of conversion from the density of the detecting patches to the ink film thickness on the printing paper.

In another preferred embodiment, the third computing step is executed by performing a computation using the following equation (2):

$$Te=[-\gamma 1*N+(1-\gamma 1)]*Td+\gamma 1*N*Tp+\gamma 2 \quad (2)$$

where Td is the ink film thickness before the presetting obtained in the first computing step, Te is the ink film thickness after the presetting obtained in the second computing step, Tp is an ink film thickness to be preset, N is the number of times of ink feeding by the ink transfer roller, γ1 and γ2 are preset factors.

The preset factors γ1 and γ2 may be corrected based on the viscosity of an ink used in printing.

In a different aspect of the invention, an ink feeding apparatus is provided for feeding a preset ink after making prints having a first image and before making prints having a second image, the apparatus comprising:

a density measuring means for measuring densities of the prints having the first image, immediately before an end of a printing operation;

a first computing means for computing, from the densities of the prints having the first image, an ink feed film thickness remaining after the prints having the first image are made;

a second computing means for computing an ink feed film thickness required for making the prints having the second image, from a target density for the prints having the second image;

a third computing means for computing a preset ink feeding rate from the ink feed film thickness remaining after the prints having the first image are made, computed by the first computing means, and the ink feed film thickness required for making the prints having the second image, computed by the second computing means; and an ink feeding means for feeding the preset ink based on the preset ink feeding rate computed by the third computing means.

Other features and advantages of the invention will be apparent from the following detailed description of the embodiments of the invention.

BRIEF DESCRIPTION OF THE DRAWINGS

For the purpose of illustrating the invention, there are shown in the drawings several forms which are presently preferred, it being understood, however, that the invention is not limited to the precise arrangement and instrumentalities shown.

DESCRIPTION OF THE PREFERRED EMBODIMENTS

Figure 1:
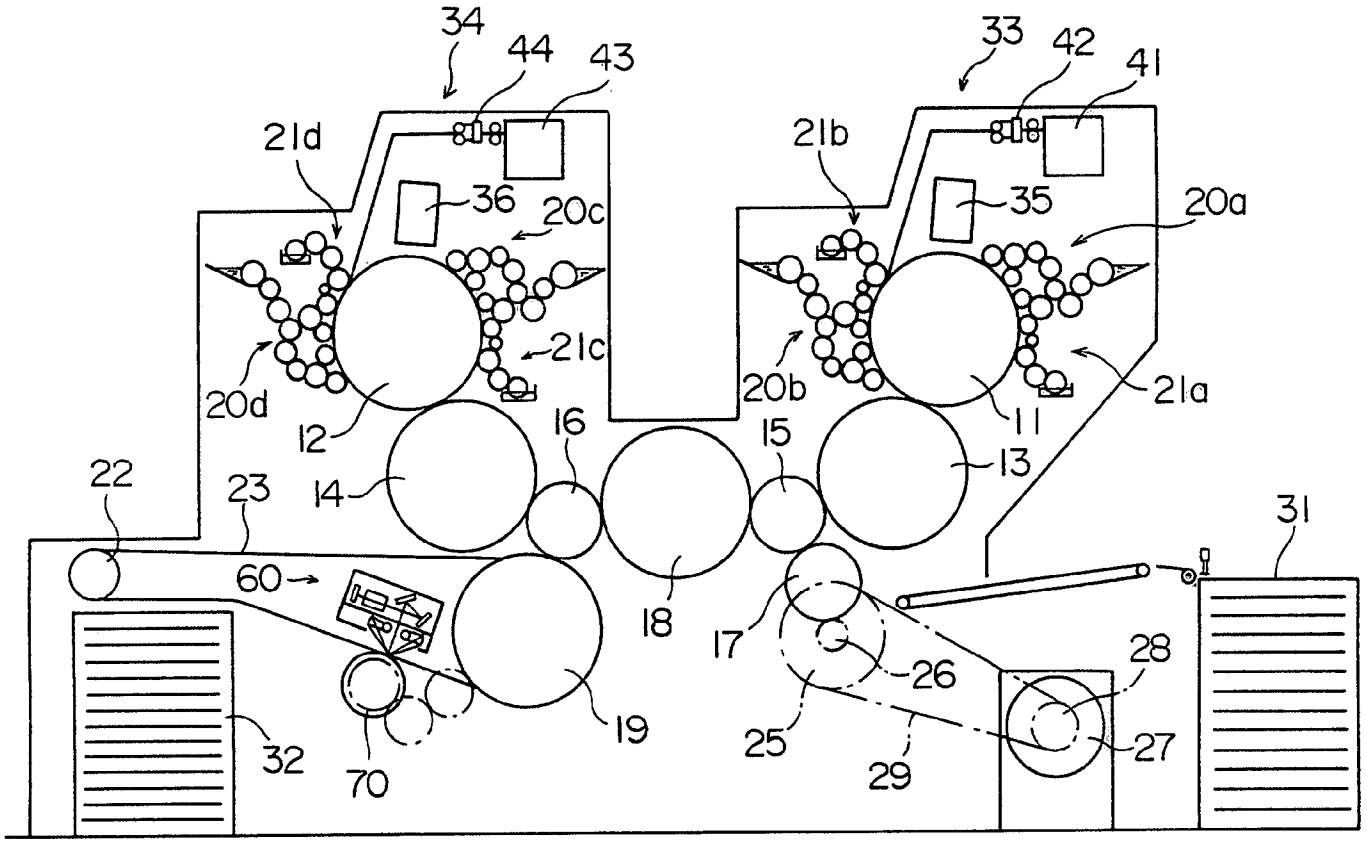
FIG. 1 is a schematic view of a printing machine according to this invention.

An embodiment of this invention will be described hereinafter with reference to the drawings. The construction of a printing machine according to this invention will be described first. FIG. 1 is a schematic view of the printing machine according to this invention.

This printing machine records images on blank plates mounted on first and second plate cylinders 11 and 12 in a prepress process, feeds inks to the plates having the images recorded thereon, and transfers the inks from the plates through first and second blanket cylinders 13 and 14 to printing paper held on first and second impression cylinders 15 and 16, thereby printing the images in four colors on the printing paper.

The printing machine has the first plate cylinder 11, the second plate cylinder 12, the first blanket cylinder 13 contactable with the first plate cylinder 11, the second blanket cylinder 14 contactable with the second plate cylinder 12, the first impression cylinder 15 contactable with the first blanket cylinder 13, and the second impression cylinder 16 contactable with the second blanket cylinder 14. The printing machine further includes a paper feed cylinder 17 for transferring printing paper supplied from a paper storage station 31 to the first impression cylinder 15, a transfer cylinder 18 for transferring the printing paper from the first impression cylinder 15 to the second impression cylinder 16, a paper discharge cylinder 19 with chains 23 wound thereon and extending to and wound on a pair of sprockets 22 for discharging printed paper from the second impression cylinder 16 to a paper discharge station 32, and an image pickup station 60 for measuring densities of detecting patches printed on the printing paper.

The first and second impression cylinders 15 and 16 movable into contact with the first and second blanket cylinders 13 and 14, respectively, have half the diameter of the first and second plate cylinders 11 and 12 and the first and second blanket cylinders 13 and 14. The first and second impression cylinders 15 and 16 have grippers, not shown, for holding and transporting the forward end of printing paper.

The paper feed cylinder 17 disposed adjacent the impression cylinder 15 has the same diameter as the first and second impression cylinders 15 and 16. The paper feed cylinder 17 has a gripper, not shown, for holding and transporting the forward end of each sheet of printing paper fed from the paper storage station 31. When the printing paper is transferred from the feed cylinder 17 to the first impression cylinder 15, the gripper of the first impression cylinder 15 holds the forward end of the printing paper which has been held by the gripper of the feed cylinder 17.

The transfer cylinder 18 disposed between the first impression cylinder 15 and second impression cylinder 16 has the same diameter as the first and second plate cylinders 11 and 12 and the first and second blanket cylinders 13 and 14. The transfer cylinder 18 has a gripper, not shown, for holding and transporting the forward end of the printing paper received from the first impression cylinder 15, and transferring the forward end of the printing paper to the gripper of the second impression cylinder 16.

Figure 4:
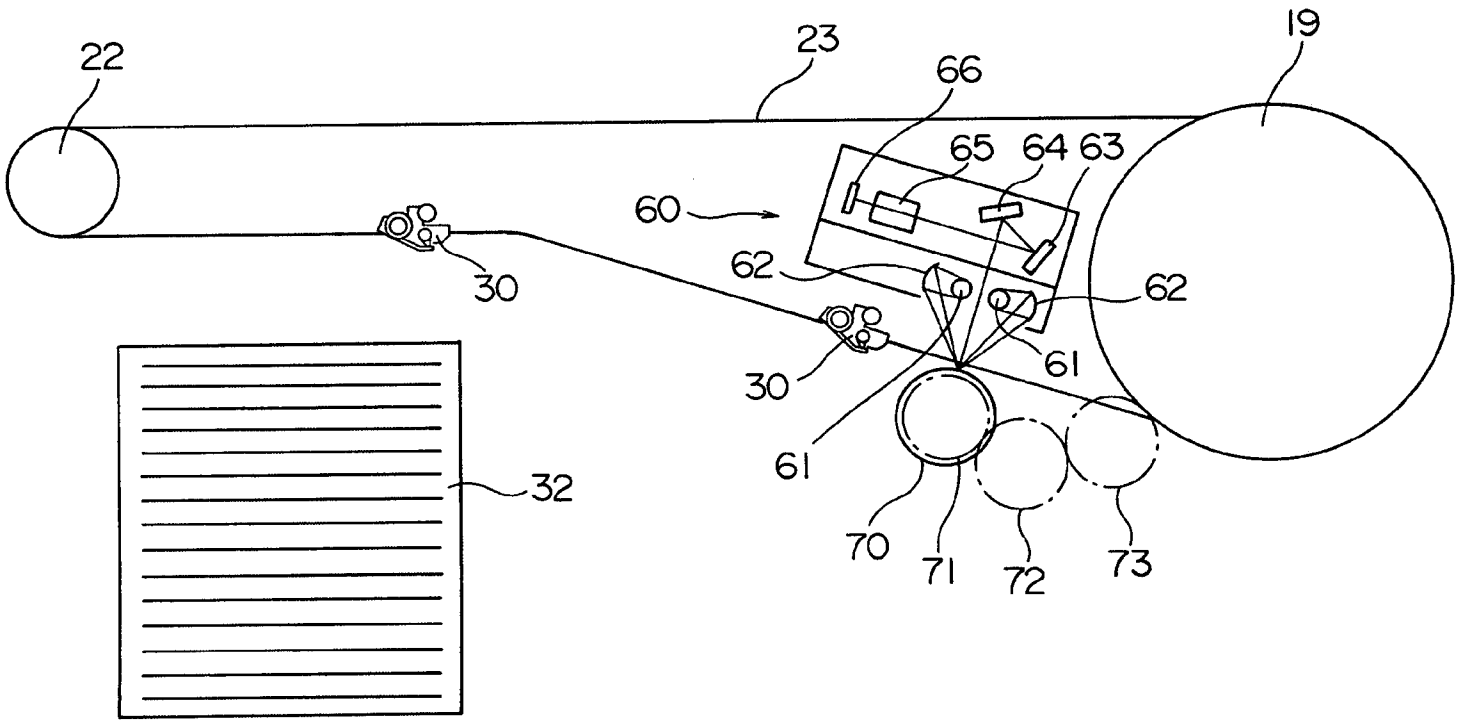
FIG. 4 is a schematic side view showing an image pickup station along with a paper discharge mechanism such as a paper discharge cylinder.

The paper discharge cylinder 19 disposed adjacent the second impression cylinder 16 has the same diameter as the first and second plate cylinders 11 and 12 and the first and second blanket cylinders 13 and 14. The discharge cylinder 19 has a pair of chains 23 wound around opposite ends thereof. The chains 23 are interconnected by coupling members, not shown, having a plurality of grippers 30 arranged thereon (FIG. 4). When the second impression cylinder 16 transfers the printing paper to the discharge cylinder 19, one of the grippers 30 on the discharge cylinder 17 holds the forward end of the printing paper having been held by the gripper of the second impression cylinder 16. With movement of the chains 23, the printing paper is transported to the paper discharge station 32 to be discharged thereon.

The paper feed cylinder 17 has a gear attached to an end thereof and connected to a gear 26 disposed coaxially with a driven pulley 25. A belt 29 is wound around and extends between the driven pulley 25 and a drive pulley 28 rotatable by a motor 27. Thus, the paper feed cylinder 17 is rotatable by drive of the motor 27. The first and second plate cylinders 11 and 12, first and second blanket cylinders 13 and 14, first and second impression cylinders 15 and 16, paper feed cylinder 17, transfer cylinder 18 and paper discharge cylinder 19 are coupled to one another by gears attached to ends thereof, respectively. Thus, by the drive of motor 27, the paper feed cylinder 17, first and second impression cylinders 15 and 16, paper discharge cylinder 19, first and second blanket cylinders 13 and 14, first and second plate cylinders 11 and 12 and transfer cylinder 18 are rotatable synchronously with one another.

The first plate cylinder 11 is surrounded by an ink feeder 20*a* for feeding an ink of black (K), for example, to a plate, an ink feeder 20*b* for feeding an ink of magenta (M), for example, to a plate, and dampening water feeders 21*a* and 21*b* for feeding dampening water to the plates. The second plate cylinder 12 is surrounded by an ink feeder 20*c* for feeding an ink of cyan (C), for example, to a plate, an ink feeder 20*d* for feeding an ink of yellow (Y), for example, to a plate, and dampening water feeders 21*c* and 21*d* for feeding dampening water to the plates.

Further, arranged around the first and second plate cylinders 11 and 12 are a plate feeder 33 for feeding plates to the peripheral surface of the first plate cylinder 11, a plate feeder 34 for feeding plates to the peripheral surface of the second plate cylinder 12, an image recorder 35 for recording images on the plates mounted peripherally of the first plate cylinder 11, and an image recorder 36 for recording images on the plates mounted peripherally of the second plate cylinder 12.

Figure 2:
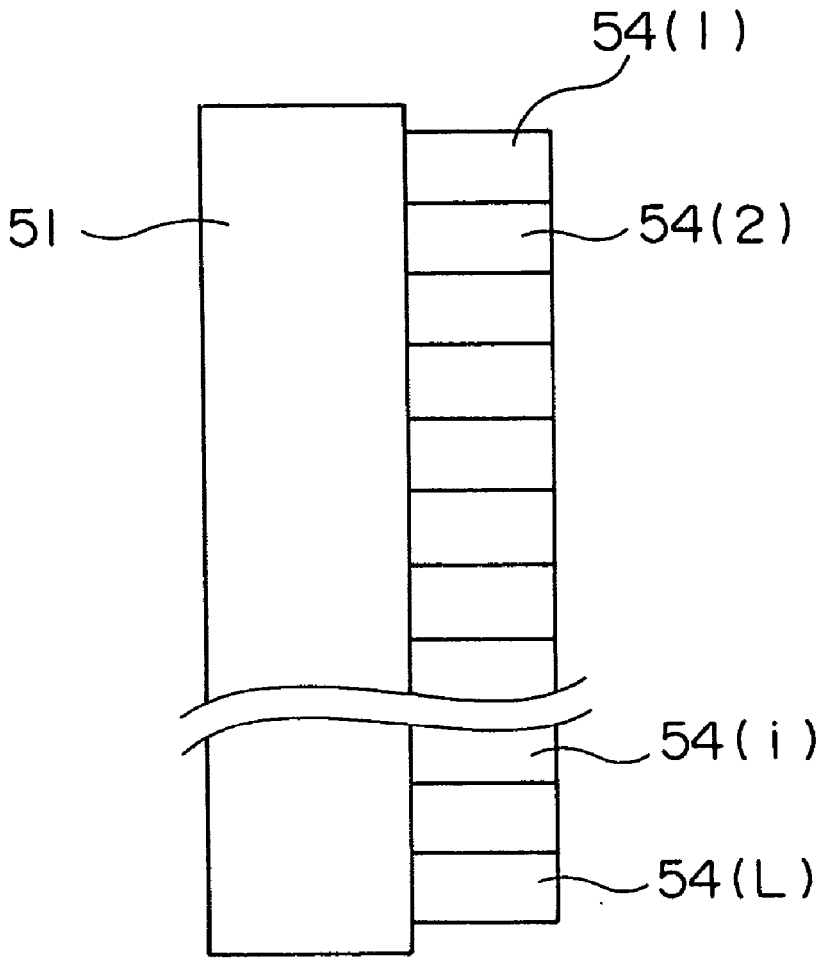
FIG. 2 is a schematic side view of an ink feeder.
Figure 3:
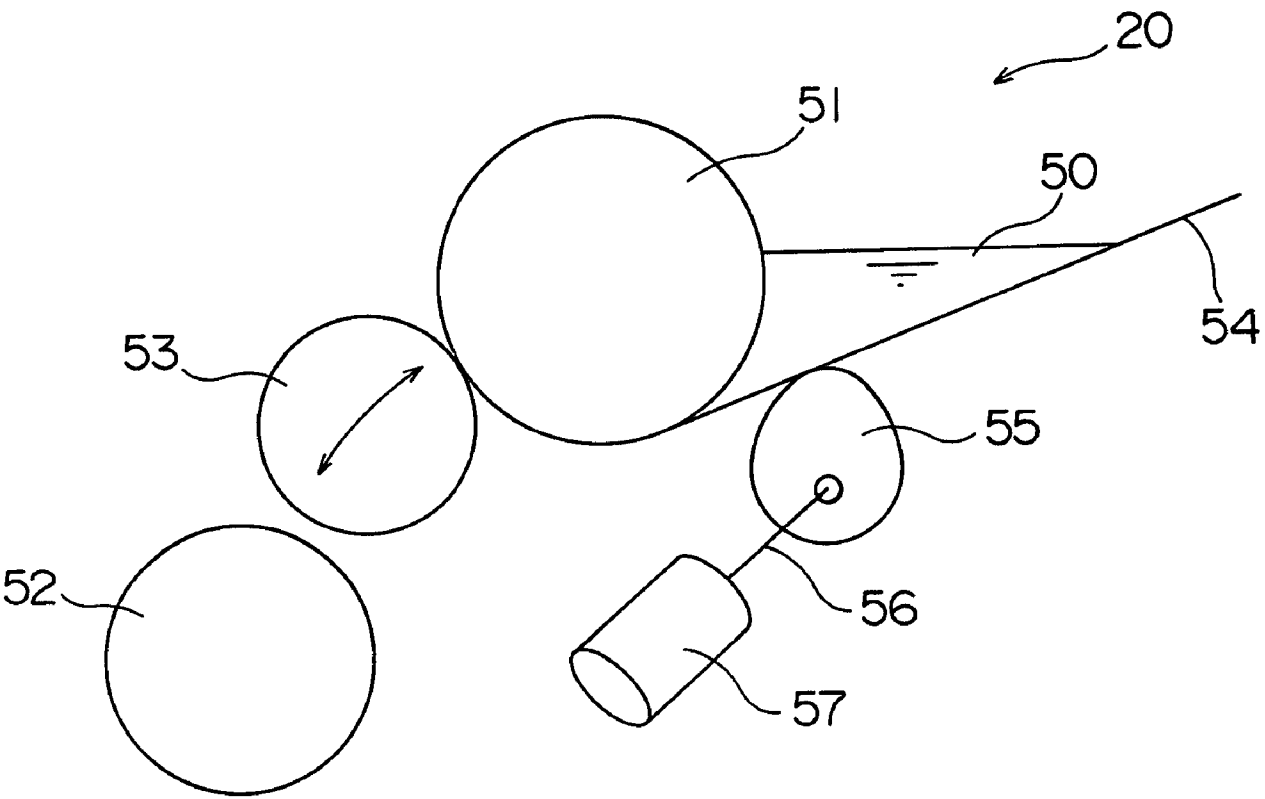
FIG. 3 is a plan view of the ink feeder.

FIG. 2 is a schematic side view of the above ink feeders 20*a*, 20*b*, 20*c* and 20*d* (which may be referred to collectively as "ink feeder 20"). FIG. 3 is a plan view thereof. Ink 50 is omitted from FIG. 3.

The ink feeder 20 includes an ink fountain roller 51 having an axis thereof extending in a direction of width of prints (i.e. perpendicular to a printing direction of the printing machine), and a plurality of ink rollers 52 (only one being shown in FIG. 2), and an ink transfer roller 53 that vibrates between the ink fountain roller 51 and a foremost one of the ink rollers 52. The ink feeder 20 further includes ink keys 54 (1), 54 (2) . . . 54 (L) (which may be referred to collectively as "ink keys 54") arranged in the direction of width of the prints. The ink fountain roller 51 and ink keys 54 define an ink well for storing ink 50.

Eccentric cams 55, L in number, are arranged under the respective ink keys 54 for pressing the ink keys 54 toward the surface of ink fountain roller 51 to vary the opening degree of each ink key 54 with respect to the ink fountain roller 51. The eccentric cams 55 are connected through shafts 56 to pulse motors 57, L in number, for rotating the eccentric cams 55, respectively.

Each pulse motor 57, in response to an ink key drive pulse applied thereto, rotates the eccentric cam 55 about the shaft 56 to vary a pressure applied to the ink key 54. The opening degree of the ink key 54 with respect to the ink fountain roller 51 is thereby varied to vary the rate of ink fed to the printing plate.

FIG. 4 is a schematic side view showing the image pickup station 60 along with the paper discharge mechanism such as the paper discharge cylinder 19.

The pair of chains 23 are endlessly wound around the opposite ends of the paper discharge cylinder 19 and the pair of sprockets 22. As noted hereinbefore, the chains 23 are interconnected by coupling members, not shown, having a plurality of grippers 30 arranged thereon each for gripping the forward end of printing paper transported. FIG. 4 shows only two grippers 30, with the other grippers 30 omitted.

The pair of chains 23 have a length corresponding to a multiple of the circumference of first and second impression cylinders 15 and 16. The grippers 30 are arranged on the chains 23 at intervals each corresponding to the circumference of first and second impression cylinders 15 and 16. Each gripper 30 is opened and closed by a cam mechanism, not shown, synchronously with the gripper on the paper discharge cylinder 19. Thus, each gripper 30 receives the printing paper from the paper discharge cylinder 19, transports the printing paper with rotation of the chains 23, and is then opened by the cam mechanism, not shown, to discharge the paper on the paper discharge station 32.

The printing paper is transported with only the forward end thereof held by one of the grippers 30, the rear end of printing paper not being fixed. Consequently, the printing paper could flap during transport, which impairs an operation, to be described hereinafter, of the image pickup station 60 to measure densities of the detecting patches. To avoid such an inconvenience, this printing machine provides a suction roller 70 disposed upstream of the paper discharge station 32 for stabilizing the printing paper transported.

The suction roller 70 is in the form of a hollow roller having a surface defining minute suction bores, with the hollow interior thereof connected to a vacuum pump not shown. The suction roller 70 has a gear 71 attached to an end thereof. The gear 71 is connected through idler gears 72 and 73 to the gear attached to an end of the paper discharge cylinder 19. Consequently, the suction roller 43 is driven to rotate in a matching relationship with a moving speed of the grippers 30. Thus, the printing paper is sucked to the surface of the suction roller 70, thereby being held against flapping when passing over the suction roller 70. In place of the suction roller 70, a suction plate may be used to suck the printing paper two-dimensionally.

The above image pickup station 60 includes a pair of linear light sources 61 extending parallel to the suction roller 70 for illuminating the printing paper on the suction roller 70, a pair of condensing plates 62, reflecting mirrors 63 and 64, a condensing lens 65 and a CCD line sensor 66. The detecting patches on the printing paper transported by the paper discharge mechanism including the paper discharge cylinder 19 and chains 23 are illuminated by the pair of linear light sources 61, and photographed by the CCD line sensor 66. The densities of the detecting patches are derived from a predetermined computation based on image data of the detecting patches photographed.

Figure 5:
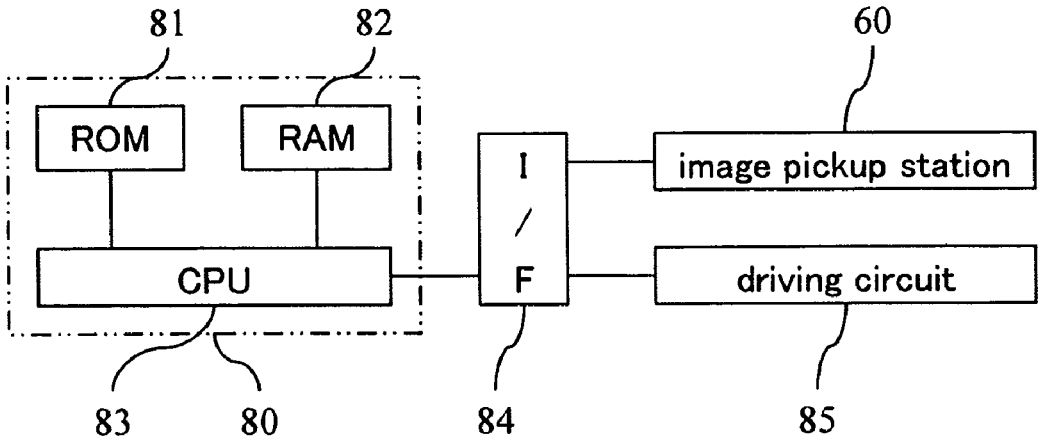
FIG. 5 is a block diagram showing a principal electrical structure of the printing machine.

FIG. 5 is a block diagram showing a principal electrical structure of the printing machine. This printing machine includes a control unit 80 having a ROM 81 for storing operating programs necessary for controlling the machine, a RAM 82 for temporarily storing data and the like during a control operation, and a CPU 83 for performing logic operations. The control unit 80 has a driving circuit 85 connected thereto through an interface 84, for generating driving signals for driving the ink feeders 20, dampening water feeders 21, image recorders 35 and 36 and so on. The control unit 80 is connected also to the image pickup station 60, and computes densities based on the image data obtained from the image pickup station 60. The printing machine is controlled by the control unit 140 to execute prepress and printing operations as described hereinafter.

The control unit 80 acts as a first, a second and a third computing devices for executing a first, a second and a third computing steps described hereinafter.

In the printing machine having the above construction, a printing plate stock drawn from a supply cassette 41 of the plate feeder 33 is cut to a predetermined size by a cutter 42. The forward end of each plate in cut sheet form is guided by guide rollers and guide members, not shown, and is clamped by clamps of the first plate cylinder 11. Then, the first plate cylinder 11 is driven by a motor, not shown, to rotate at low speed, whereby the plate is wrapped around the peripheral surface of the first plate cylinder 11. The rear end of the plate is clamped by other clamps of the first plate cylinder 11. While, in this state, the first plate cylinder 11 is rotated at low speed, the image recorder 35 irradiates the surface of the plate mounted peripherally of the first plate cylinder 11 with a modulated laser beam for recording an image thereon.

Similarly, a printing plate stock drawn from a supply cassette 43 of the plate feeder 34 is cut to the predetermined size by a cutter 44. The forward end of each plate in cut sheet form is guided by guide rollers and guide members, not shown, and is clamped by clamps of the second plate cylinder 12. Then, the second plate cylinder 12 is driven by a motor, not shown, to rotate at low speed, whereby the plate is wrapped around the peripheral surface of the second plate cylinder 12. The rear end of the plate is clamped by other clamps of the second plate cylinder 12. While, in this state, the second plate cylinder 12 is rotated at low speed, the image recorder 36 irradiates the surface of the plate mounted peripherally of the second plate cylinder 12 with a modulated laser beam for recording an image thereon.

The first plate cylinder 11 has, mounted peripherally thereof, a plate for printing in black ink and a plate for printing in magenta ink. The two plates are arranged in evenly separated positions (i.e. in positions separated from each other by 180 degrees). The image recorder 35 records images on these plates. Similarly, the second plate cylinder 12 has, mounted peripherally thereof, a plate for printing in cyan ink and a plate for printing in yellow ink. The two plates also are arranged in evenly separated positions, and the image recorder 36 records images on these plates, to complete a prepress process.

The prepress process is followed by a printing process for printing the printing paper with the plates mounted on the first and second plate cylinders 11 and 12. This printing process is carried out as follows.

First, each dampening water feeder 21 and each ink feeder 20 are placed in contact with only a corresponding one of the plates mounted on the first and second plate cylinders 11 and 12. Consequently, dampening water and inks are fed to the plates from the corresponding water feeders 21 and ink feeders 20, respectively. These inks are transferred from the plates to the corresponding regions of the first and second blanket cylinders 13 and 14, respectively.

Then, the printing paper is fed to the paper feed cylinder 17. The printing paper is subsequently passed from the paper feed cylinder 17 to the first impression cylinder 15. The impression cylinder 15 having received the printing paper continues to rotate. Since the first impression cylinder 15 has half the diameter of the first plate cylinder 11 and the first blanket cylinder 13, the black ink is transferred to the printing paper wrapped around the first impression cylinder 15 in its first rotation, and the magenta ink in its second rotation.

After the first impression cylinder 15 makes two rotations, the printing paper is passed from the first impression cylinder 15 to the second impression cylinder 16 through the transfer cylinder 18. The second impression cylinder 16 having received the printing paper continues to rotate. Since the second impression cylinder 16 has half the diameter of the second plate cylinder 12 and the second blanket cylinder 14, the cyan ink is transferred to the printing paper wrapped around the second impression cylinder 16 in its first rotation, and the yellow ink in its second rotation.

The forward end of the printing paper printed in the four colors in this way is passed from the second impression cylinder 16 to the paper discharge cylinder 19. The printing paper is transported by the pair of chains 23 toward the paper discharge station 32 to be discharged thereon.

At this time, the detecting patches on the printing paper being transported are illuminated by the pair of linear light sources 61, and are photographed by the CCD line sensor 66.

After the printing process, the printing paper printed is discharged. The first and second blanket cylinders 13 and 14 are cleaned by a blanket cylinder cleaning device, not shown, to complete the printing process.

When a plurality of prints are continuously made with this type of printing machine, the quantity of ink corresponding to the image of preceding prints remains on the ink rollers of the printing machine. For continuing the printing operation, therefore, a preset operation is carried out for adjusting the thickness of ink film on the ink rollers to a size corresponding to an image to be printed next.

Figure 6:
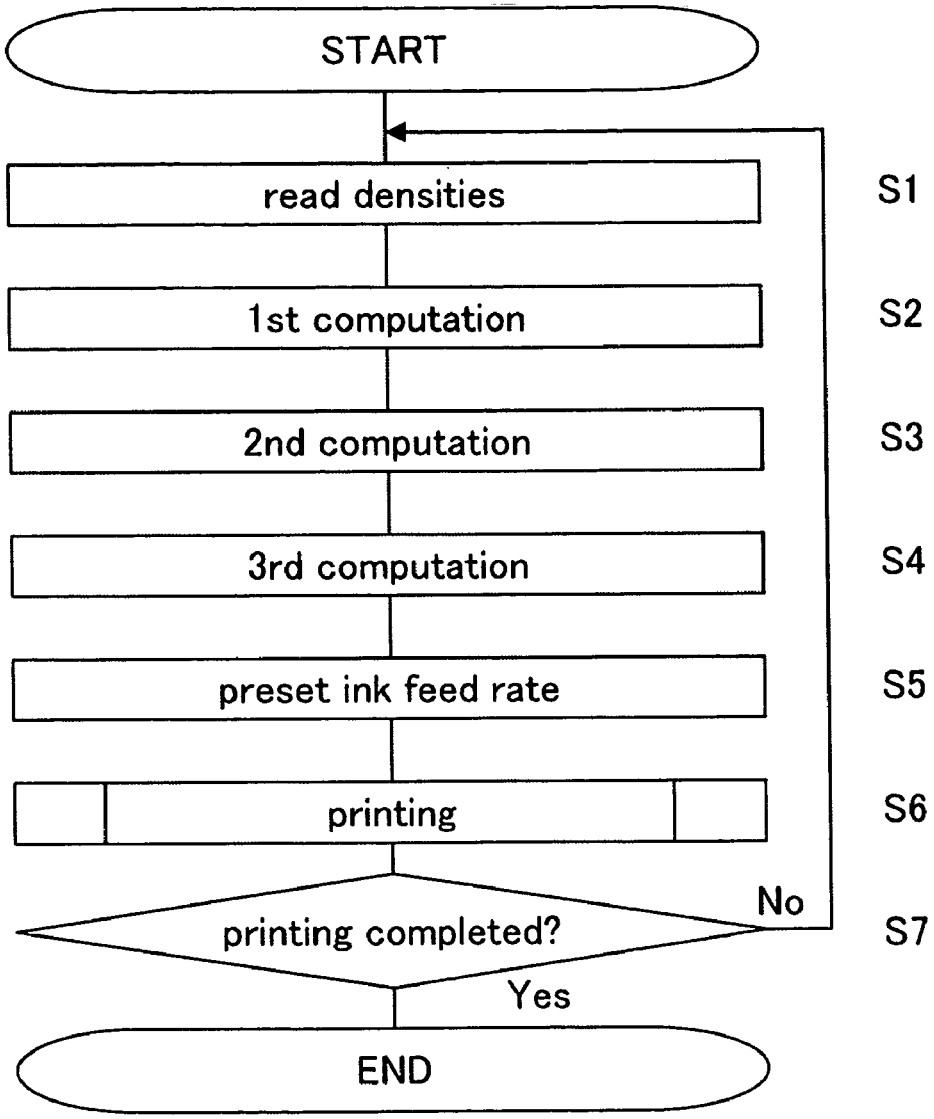
FIG. 6 is a flow chart of an ink feeding operation.

An ink feeding operation according to this invention that effects such a preset operation will be described hereinafter. FIG. 6 is a flow chart showing the ink feeding operation.

The preset operation is carried out after making prints having a first image and before making prints having a second image different from the first image. However, in order to carry out this preset operation, density data must be obtained by measuring the prints having the first image. This density data is obtained, for example, by measuring the densities of the detecting patches on the first image. Specifically, this density data is obtained through a computation performed after photographing the detecting patches serially at the image pickup station 60 while printing the first image. This density data is stored serially in the RAM 82 of the control unit 80.

When presetting an ink feeding rate, the control unit 80 first reads, from the RAM 82, particularly density data obtained immediately before the end of the printing operation among the density data of the first image so far printed (Step S1). The term "immediately before the end of the printing operation" denotes a time that enables an estimation of a film thickness of ink fed at a point of time of ending the printing operation. This is a concept including a certain period before the end of printing, e.g. a period in which 50 to 100 prints are made before the end of printing.

Next, a first computing step is executed for determining, from the density data, an ink feed film thickness remaining after making prints having the first image (Step S2). Specifically, the computation is performed by using the following equation (1):

$$T=\alpha*(a*D+b)+\beta \quad (1)$$

where D is a density of the detecting patches in the density data read in the preceding step, T is an ink film thickness on the ink rollers 52 contactable with the first and second plate cylinders 11 and 12, α and β are factors of conversion from an ink film thickness on the printing paper to the ink film thickness on the ink rollers 52, and a and b are factors of conversion from the density of the detecting patches to the ink film thickness on the printing paper. The above conversion factors α, β, a and b are obtained empirically.

The value of T determined as above is stored as an ink film thickness Td before the preset operation. When determining this ink film thickness Td, variations in the result of computation are suppressed by averaging, or weighting and averaging, a plurality of density data obtained by serially measuring about 50 to 100 prints, for example, made immediately before the end of the printing operation. However, the above value may be determined by using a single density data obtained immediately before the end of the printing operation.

A second computing step is executed for determining an ink feed film thickness needed when making prints having the second image, from a target density for the prints having the second image to be made next (step S3). Specifically, the computation is carried out by using a target density for the detecting patches as the density D of the detecting patches in the above equation (1). The value of T determined in this way is stored as an ink film thickness Te after the preset operation.

In the first computing step and second computing step described above, accuracy may be improved by correcting the conversion factors α and β based on variations in the density of the detecting patches serially measured a plurality of times immediately before the end of the printing operation for making prints having the first image.

As described above, in time of the preceding printing operation for making prints having the first image, the prints are serially photographed at the image pickup station 60, and the density data is obtained serially by measuring the densities of the detecting patches on the first image during the printing operation. Thus, the conversion factors α and β are corrected by referring to a density history of about 50 to 100 prints made immediately before the end of the printing operation. Specifically, a correcting computation may be performed by using the following linear equations:

$$\alpha'=d*C+\alpha+e$$

$$\beta'=f*C+\beta+g$$

where C is a density gradient obtained from the density history, α' and β' are corrected conversion factors, and d, e, f and g are coefficients.

In the first computing step and second computing step described above, accuracy may be improved by correcting the conversion factors a and b based on an image area ratio of the prints having the second image to be made next. Specifically, this correcting computation may be performed by using the following linear equations:

$$a'=h*M+a+i$$

$$b'=j*M+b+k$$

where M is the image area ratio, a' and b' are the corrected conversion factors, and h, i, j and k are coefficients.

Next, a third computing step is executed for determining a preset ink feeding rate for making prints having the second image, from the ink feed film thickness, obtained in the first computing step, in time of making the prints having the first image, and the ink feed film thickness, obtained in the second computing step, in time of making the prints having the second image (step S4). Specifically, the computation in the third computing step is carried out by using the following equation (2):

$$Te=[-\gamma 1*N+(1-\gamma 1)]*Td+\gamma 1*N*Tp+\gamma 2 \quad (2)$$

where Td is the ink film thickness before the presetting obtained in the first computing step, Te is the ink film thickness after the presetting obtained in the second computing step, Tp is an ink film thickness to be preset, N is the number of times the ink is to be fed by the ink transfer roller shown in FIG. 2, and γ1 and γ2 are preset factors. The preset factors γ1 and γ2 are obtained empirically.

The above equation (2) includes two unknowns which are the ink film thickness Tp to be preset, and the number of times N the ink is to be fed by the ink transfer roller. To obtain optimal values for these unknowns, a convergence calculation is performed using an optimizing method by multiple linear regression analysis, such as the least squares method or Newton's method.

In the third computing step described above, accuracy may be improved by correcting the preset factors γ1 and γ2 based on the viscosity of the ink used in printing. This correcting computation may be performed by using a linear expression.

The ink is fed based on the ink film thickness Tp and the number of times N the ink is to be fed by the ink transfer roller determined in this way, to preset an ink feeding rate. Specifically, the control unit 80 drives the pulse motors 57 to vary the opening degrees of the ink keys 54 relative to the ink fountain roller 51, and controls the frequency of vibration of the ink transfer roller 53. Consequently, the ink preset operation may be carried out quickly and accurately.

After the ink preset operation, an operation is carried out for making prints having the second image (step S6). During this printing operation, densities of the detecting patches on the second image are constantly measured, and the ink feeding rate is controlled based on the density data obtained. The density data obtained by measuring the densities of the detecting patches is used in a subsequent operation for presetting the ink feeding rate.

When the prints having the second image have been made, a checking is carried out whether it is necessary to make prints having a next, different image (Step S7). When prints having a next image are required, the procedure returns to step S1 to continue the printing operation. Otherwise, the operation is ended.

This invention may be embodied in other specific forms without departing from the spirit or essential attributes thereof and, accordingly, reference should be made to the appended claims, rather than to the foregoing specification, as indicating the scope of the invention.

This application claims priority benefit under 35 U.S.C. Section 119 of Japanese Patent Application No. 2003-329438 filed in the Japanese Patent Office on Sep. 22, 2003, the entire disclosure of which is incorporated herein by reference.

What is claimed is:

1. An ink feeding method for feeding a preset ink to form an ink film on an ink roller of a printing machine to print a first image, in which a presetting operation is required to adjust a thickness of the ink film to a second image to be printed subsequently to the first image, said method comprising:

a density reading step for reading density data obtained by measuring density of the printed first image;

a first computing step for computing, from said density data, a thickness of the ink film remaining on the ink roller after said first image is printed;

a second computing step for computing a thickness of the ink film required for printing said second image, from a target density for said second image; and a third computing step for computing a preset ink feeding rate from the thickness of the ink film remaining on the ink roller after said first image is printed, computed in said first computing step, and the thickness of the ink film required for said second image, computed in said second computing step.

2. An ink feeding method as defined in claim 1, wherein the first image is printed more than once, the density of the printed first image is measured when the first image is printed, and said density data is obtained from density of the printed first image measured immediately before the end of a printing operation for the first image.

3. An ink feeding method as defined in claim 2, wherein said first computing step and said second computing step are executed by performing computations using the following equation (1):

$$T=\alpha*(a*D+b)+\beta \quad (1)$$

where D is density of detecting patches in the printed first image, T is an ink film thickness on ink rollers, α and β are factors of conversion from an ink film thickness on a printing paper to the ink film thickness on the ink rollers, and a and b are factors of conversion from the density of the detecting patches to the ink film thickness on the printing paper.

4. An ink feeding method as defined in claim 3, wherein said factors of conversion α and β are corrected based on variations in the density of the detecting patches in the printed first image measured immediately before the end of the printing operation for said first image.

5. An ink feeding method as defined in claim 3, wherein said factors of conversion a and b are corrected based on an image area ratio of the printed first image.

6. An ink feeding method as defined in claim 1, wherein said first computing step and said second computing step are executed by performing computations using the following equation (1):

$$T=\alpha*(a*D+b)+\beta \quad (1)$$

where D is density of detecting patches in the printed first image, T is an ink film thickness on ink rollers, α and β are factors of conversion from an ink film thickness on a printing paper to the ink film thickness on the ink rollers, and a and b are factors of conversion from the density of the detecting patches to the ink film thickness on the printing paper.

7. An ink feeding method as defined in claim 6, wherein said factors of conversion α and β are corrected based on variations in the density of the detecting patches in the printed first image measured immediately before the end of the printing operation for said first image.

8. An ink feeding method as defined in claim 6, wherein said factors of conversion a and b are corrected based on an image area ratio of the printed first image.

9. An ink feeding method as defined in claim 1, wherein said preset ink feeding rate comprises an ink film thickness and a number of times of ink feeding by an ink transfer roller.

10. An ink feeding method as defined in claim 9, wherein said first computing step and said second computing step are executed by performing computations using the following equation (1):

$$T=\alpha*(a*D+b)+\beta \quad (1)$$

where D is a density of detecting patches in the printed first image, T is an ink film thickness on ink rollers, α and β are factors of conversion from an ink film thickness on a printing paper to the ink film thickness on the ink rollers, and a and b are factors of conversion from the density of the detecting patches to the ink film thickness on the printing paper.

11. An ink feeding method as defined in claim 10, wherein said factors of conversion α and β are corrected based on variations in the density of the detecting patches in the printed first image measured immediately before the end of the printing operation for said first image.

12. An ink feeding method as defined in claim 10, wherein said factors of conversion a and b are corrected based on an image area ratio of the printed first image.

13. An ink feeding method as defined in claim 9, wherein said third computing step is executed by performing a computation using the following equation (2):

$$Te=[-\gamma 1*N+(1-\gamma 1)]*Td+\gamma 1*N*Tp+\gamma 2 \quad (2)$$

where Td is the ink film thickness before the presetting obtained in said first computing step, Te is the ink film thickness after the presetting obtained in said second computing step, Tp is an ink film thickness to be preset, N is the number of times of ink feeding by the ink transfer roller, γ1 and γ2 are preset factors.

14. An ink feeding method as defined in claim 13, wherein said preset factors γ1 and γ2 are corrected based on a viscosity of an ink used in printing.

15. An ink feeding method as defined in claim 14, wherein said third computing step is executed to determine values of the ink film thickness Tp to be preset, and the number of times N of ink feeding by the ink transfer roller, by using multiple linear regression analysis.

16. An ink feeding apparatus for feeding a preset ink to form an ink film on an ink roller of a printing machine to print a first image, in which a presetting operation is required to adjust a thickness of the ink film to a second image to be printed subsequently to the first image, said apparatus comprising:

density measuring means for measuring density of the printed first image;

first computing means for computing, from the density of said printed first image, a thickness of the ink film remaining on the ink roller after said first image is printed;

second computing means for computing a thickness of the ink film required for printing said second image, from a target density for said second image;

third computing means for computing a preset ink feeding rate from the thickness of the ink film remaining on the ink roller after said first image is printed, computed by said first computing means, and the thickness of the ink film required for said second image, computed by said second computing means; and ink feeding means for feeding the preset ink to the ink roller based on the preset ink feeding rate computed by said third computing means.

17. An ink feeding apparatus as defined in claim 16, wherein the first image is printed more than once, the density of the printed first image is measured when the first image is printed, and said density data is obtained from density of the printed first image measured immediately before the end of a printing operation for the first image.

18. An ink feeding apparatus as defined in claim 16, wherein said preset ink feeding rate comprises an ink film thickness and a number of times of ink feeding by an ink transfer roller.

19. An ink feeding apparatus as defined in claim 18, wherein the first image is printed more than once, the density of the printed first image is measured when the first image is printed, and said density data is obtained from density of the printed first image measured immediately before the end of a printing operation for the first image.

* * * * *